US006311442B1

(12) United States Patent
Watanabe

(10) Patent No.: US 6,311,442 B1
(45) Date of Patent: Nov. 6, 2001

(54) EXTERNAL CORNER FORMATIVE MEMBER

(75) Inventor: Morimichi Watanabe, Aichi (JP)

(73) Assignee: Nichiha Corp., Aichi (JP)

( * ) Notice: Subject to any disclaimer, the term of this patent is extended or adjusted under 35 U.S.C. 154(b) by 0 days.

(21) Appl. No.: 09/449,491

(22) Filed: Nov. 29, 1999

(30) Foreign Application Priority Data

Mar. 24, 1999 (JP) ..... 11-079826

(51) Int. Cl.[7] ..... E04B 1/38

(52) U.S. Cl. ..... 52/282.3; 52/272; 52/278; 52/279; 52/282.1; 156/91

(58) Field of Search ..... 156/91–92; 52/272, 52/275, 276, 277, 278, 279, 280, 281, 282.1, 282.2, 282.3, 282.4, 384, 385–387, 518–520, 532, 656.2, 656.9, 658

(56) References Cited

U.S. PATENT DOCUMENTS 6,000,176 * 12/1999 Lancaster ..... 52/198

FOREIGN PATENT DOCUMENTS 08246655 9/1996 (JP) .
08246656 9/1996 (JP) .
10-8683 1/1998 (JP) .
10088773 4/1998 (JP) .
10-280641 10/1998 (JP) .
10280641 * 10/1998 (JP) ..... E04F/13/08
11172909 6/1999 (JP) .
11256761 9/1999 (JP) .

OTHER PUBLICATIONS

English Language Abstract of JP 10–8683.
English Language Abstract of JP 10–280641.

* cited by examiner

*Primary Examiner*—Michael W. Ball
*Assistant Examiner*—Jessica Rossi
(74) *Attorney, Agent, or Firm*—Lowe Hauptman Gilman & Berner, LLP

(57) ABSTRACT

An external corner formative member which comprises an angled corner plate portion, and a pair of groove portions formed on the opposite sides of the corner plate, respectively, for receiving a side edge portion of a building board, wherein at least one rib which is adapted to be contacted with the building board so as to function as a weir for preventing rain water from penetrating (or for receiving the kinetic energy of rain water) is projected from the bottom of the groove portions. A broad space is formed between the rib and a back plate portion of the groove so as to interrupt the flow of rain water running toward the interior of building frame. A ridge functioning as a weir may be formed on the back plate portion of the groove portion.

17 Claims, 4 Drawing Sheets

EXTERNAL CORNER FORMATIVE MEMBER

BACKGROUND OF THE INVENTION

The present invention relates to an external corner formative member, which forms a part of an external corner portion of a building.

In related art of ceramic siding boards for buildings, an external corner post has been employed at an external corner of a building. The external corner post is a member which covers a corner portion of exterior walls to form decorated surfaces with building boards. A fixed interval is ensured by making use of fixtures between side edges of the external corner post and a building board, and after all building boards and external corner posts have been attached to the exterior walls, the interval is filled with sealing compound to prevent leakage of rain water.

In prior art, several kinds of external corner formative member have been proposed (Japanese Patent Unexamined Application H10-280641, Japanese Patent Unexamined Application H10-8683, etc.), which is generally constructed such that it comprises an angled corner plate portion, and a pair of groove portions formed on the opposite sides of the corner plate, respectively. In this case, the external corner formative member is adapted to be attached to an external corner portion of a building in such a manner that the side edge portion of a building board to be attached as a siding board is fitted in the groove portion thereby to allow the side edge portion of a building board to be covered by the external corner formative member, and at the same time, the external corner portion of a building is also covered by the angled corner plate portion.

When an external corner formative member of this kind is employed, an external corner post that has been formed of the same kind of material as that of the building board is no more required to be employed, and at the same time, the work of filling a sealing material is no more required, thus making it possible to simplify the constructing work of the external corner portion of a building.

However, when the external corner portion of a building is constructed using this conventional external corner formative member, the side edge portion of a building board is simply fitted in the groove portion of the external corner formative member without performing a work to fill the groove portion with a sealing material. Therefore, rain water is more likely to be allowed to pass through a gap formed between the front plate portion of the groove and the building board inserted therein, and then to penetrate, while turning around the side edge of the building board, into the inner side of the building board, thus causing the building frame to become wet with rain water.

With a view to prevent rain water from penetrating into the groove portion, there has been proposed an idea to internally bend the side edge portion of the front plate portion of the groove so as to make the bent portion function as a kind of weir, or an idea of forming a plurality of lips on the back plate portion of the groove so as to make the lips function as a sort of weir. However, when the present inventors have conducted a leakage test on the external corner formative members constructed based on these ideas by making use of a hose for showering, these external corner formative members are found insufficient in water leakage prevention.

SUMMARY OF THE INVENTION

The present invention has been made under the circumstances as mentioned above, and therefore, an object of the present invention is to provide an external corner formative member which comprises an angled corner plate portion, and a pair of groove portions formed on the opposite sides of the corner plate, respectively, and which is capable of effectively preventing rain water from turning around from the front plate portion of the groove into the back plate portion of the groove, thus completely preventing rain water from entering into the building frame portion.

The leakage of rain water through the board siding of a building into the inside of a room is generated by the following factors, i.e. a first factor is the existence of rain water on the surface of the board siding, a second factor is the existence of a gap in the board siding enabling rain water to pass therethrough, and a third factor is the existence of the force to cause rain water to move toward the interior of the room. This force causing rain water to move into the interior of room may be ascribed to capillary phenomena, differences in atmospheric pressure, the kinetic energy of rain water, a surface tension, or an influence of air current. As a result of profound study to prevent the leakage of rain water through the board siding thereby to solve the aforementioned problem, it has been found by the present inventors that to take countermeasures to cope with the problems of differences in atmospheric pressure and of the kinetic energy of rain water among the aforementioned various factors is most effective in the prevention of the leakage of rain water through the board siding of a building.

Namely, with a view to realize the aforementioned problems, the present invention provides an external corner formative member, which comprises an angled corner plate portion; and a pair of groove portions formed on the opposite sides of the corner plate, respectively for allowing a side edge portion of a building board to be fitted therein, wherein at least one rib which is adapted to be contacted with a side edge portion of said building board and hence to function as a weir for preventing rain water from penetrating into an inside of the building board is projected from a bottom of each of said groove portions. The side edge portion of the front plate portion of each of said groove portions may be internally bent so as to make the bent portion function as a weir.

When the external corner portion of a building is constructed using the external corner formative member of the present invention, the internally bent portion of the front plate portion of each groove portion (if formed) functions as a weir for receiving the kinetic energy of rain water. Rain water that has passed through a narrow gap that may happen to be formed between the surface of the building board inserted into the groove and the aforementioned bent portion of the front plate portion of the groove is turned into a state of so-called reduced-pressure as the rain water enters into the space formed inside the groove, so that the flow thereof toward the inside of the building board is interrupted, thus causing most of the rain water to flow downward through this space functioning in this case as a gutter.

Rain water that has failed to flow downward through this space reaches the rib formed on the bottom of the groove portion. The rib also functions as a weir for receiving the kinetic energy of rain water, so that the rain water is caused to fall along the rib. As a result, the leakage of rain water into the building frame portion disposed behind the building board can be almost perfectly prevented. If this rib is formed in a plural number, the aforementioned leakage preventive effect can be achieved by every rib, so that the leakage preventive function of the external corner formative member can be further enhanced.

According to a preferable embodiment of the present invention, the external corner formative member is provided with a broad space formed between the rib formed on the bottom of the groove and the back plate portion of the groove, this broad space being designed to be mostly left remained even when the side edge portion of a building board is fitted in the groove portion. In this embodiment, even if rain water has succeeded to pass through a narrow gap that may happen to be formed between the rib and the side edge portion of the building board inserted into the groove, the rain water is also turned into a state of so-called reduced-pressure as it enters into this broad space formed inside the groove, so that the flow thereof toward the inside of the building board is interrupted, thus causing the rain water to flow downward through this broad space functioning in this case as a gutter. As a result, the phenomenon of rain water to turn around the side edge of the building board beyond this broad space into the inner side of the building board can be substantially prevented.

According to a further preferable embodiment of the present invention, the external corner formative member is provided on the back plate portion of each of the groove portions with a ridge which is adapted to be contacted with the back surface of a building board to be fitted in the groove, thereby functioning as a weir for preventing rain water from penetrating into the inside of a building frame. Due to the provision of the aforementioned broad space, most rain water can be prevented from reaching the back plate portion of the groove. However, even if rain water has succeeded to reach the back plate portion of the groove, the rain water can be prevented from further penetrating into the inside of the building board, and therefore, is caused to fall downward from this ridge portion, thus making it possible to further ensure the effect of preventing the leakage of rain water.

DESCRIPTION OF THE PREFERRED EMBODIMENT

Figure 1:
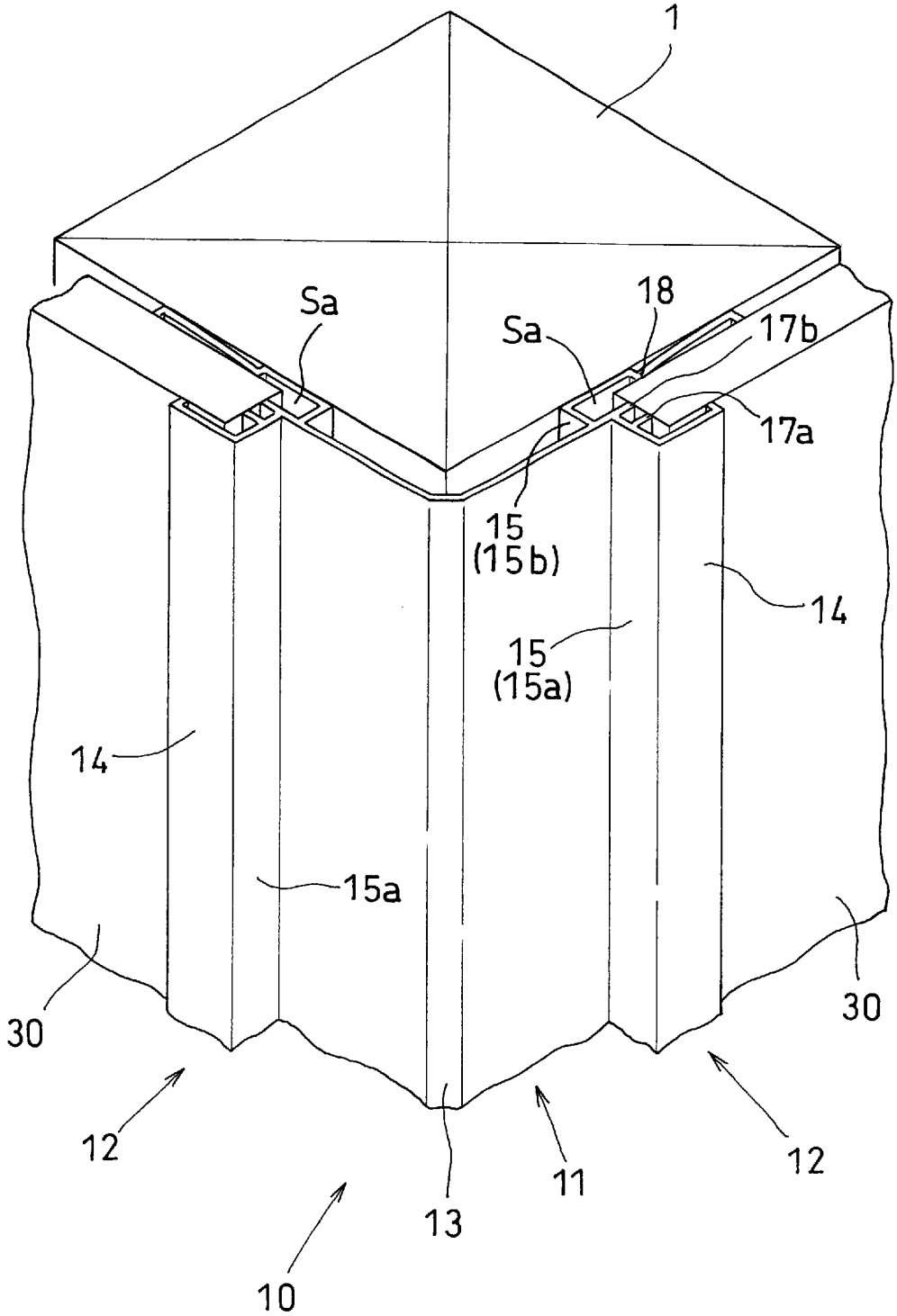
FIG. 1 is a perspective view of the external corner portion of a building frame to which building boards are attached by making use of an external corner formative member of the present invention.
Figure 2:
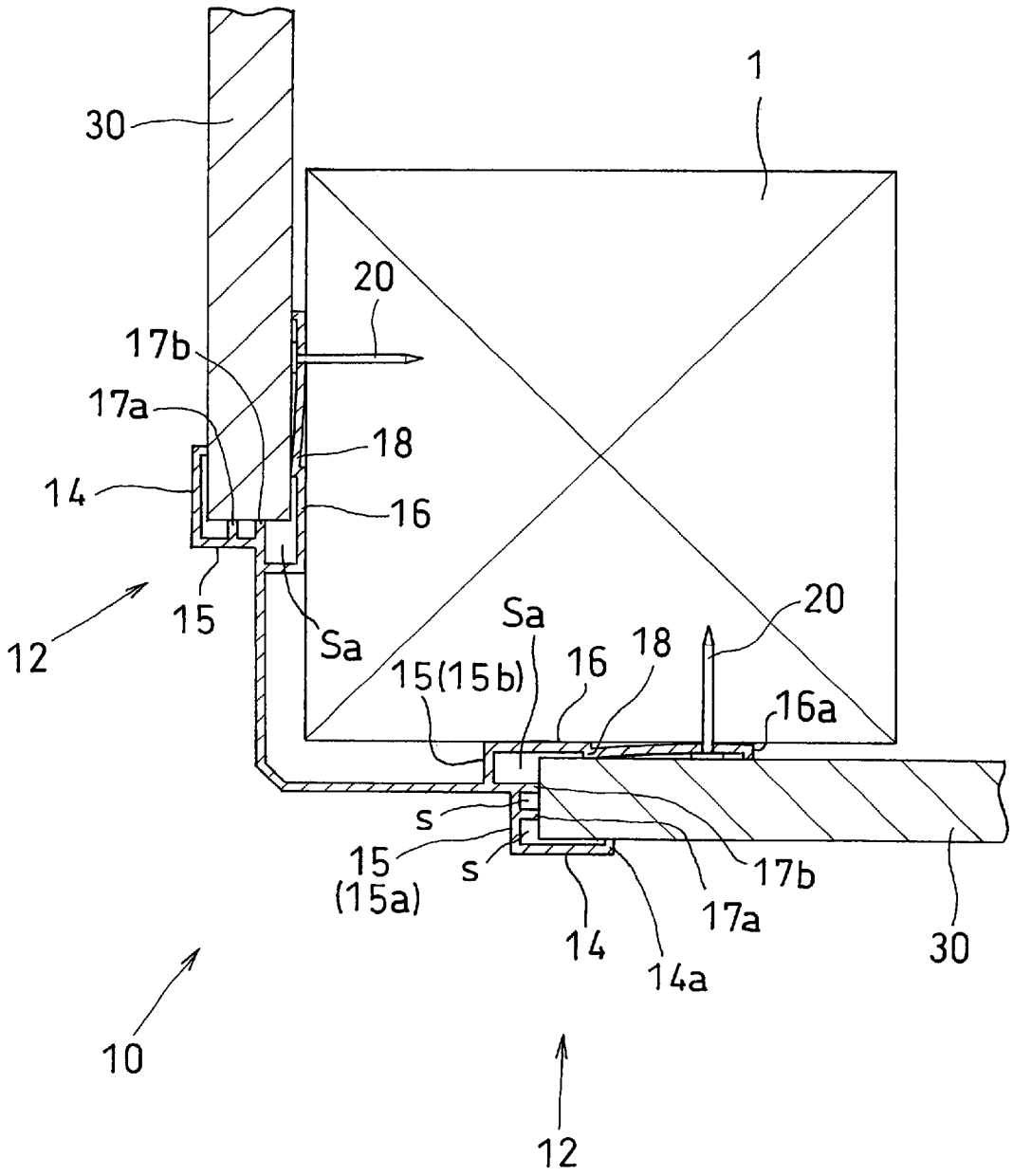
FIG. 2 is a cross-sectional view of the external corner portion of a building frame shown in FIG. 1, as it is horizontally cut.

Preferable embodiments of the external corner formative member according to the present invention will be explained in detail below with reference to the drawings. FIG. 1 is a perspective view, wherein a pair of building boards 30 are attached to an external corner portion (in this embodiment, this corner portion is represented by a pole 1) of a building frame by making use of an external corner formative member 10 of the present invention. FIG. 2 is a cross-sectional view of the external corner portion of a building frame shown in FIG. 1, as it is horizontally cut. As shown in FIG. 2, the external corner formative member 10 is designed to be attached to the pole 1 by making use of a nail 20.

In this embodiment, the external corner formative member 10 is formed of an integral fitting through an extrusion molding of aluminum. Specifically, this external corner formative member 10 comprises an angled corner plate portion 11 which is angled in conformity with the angle of the external corner portion of a building frame; and a pair of groove portions 12 formed on the opposite sides (right and left sides) of the corner plate 11, respectively. In this embodiment, the corner plate portion 11 is bent at an angle of 90 degree, and the angled portion 13 of the angled corner plate portion 11 is chamfered at an angle of 45 degrees thereby enhancing the external design thereof.

Each groove portion 12 is constituted by a front plate portion 14, a bottom plate portion 15 and a back plate portion 16. Preferably, the back plate portion 16 is attached to the pole 1 by making use of a nail 20 so that the head of the nail 20 is hidden behind a building board. The side edge portion of the front plate portion 14 is internally bent to form a lip 14*a*, the tip end of which is adapted to be contacted with the surface of a building board 30 to be fitted in the groove portion 12. Thus, the lip 14*a* functions as a first weir for receiving the kinetic energy of rain water, thereby preventing rain water from penetrating into the interior of the groove portion 12.

The bottom plate portion 15 is constituted in this embodiment by a first bottom portion 15*a* disposed in front of the angled corner plate portion 11, and a second bottom portion 15*b* disposed behind the angled corner plate portion 11. This first bottom portion 15*a* is provided with a pair of ribs 17*a* and 17*b* having the same height with each other. These ribs 17*a* and 17*b* are adapted to be contacted with the side edge portion of the building board 30 to be fitted in the groove portion 12, thereby functioning as a second weir and a third weir, respectively, for receiving the kinetic energy of rain water. Rain water that has passed through a narrow gap that may happen to be formed between the surface of the building board 30 inserted into the groove portion 12 and the tip end of the lip 14*a* is prevented from passing over these ribs 17*a* and 17*b*, thus causing most of the rain water to flow downward along these ribs 17*a* and 17*b*.

As shown in FIG. 2, the surface of the building board 30 is contacted only with the lip 14*a*, while the end face of the building board 30 is contacted only with the tip ends of the ribs 17*a* and 17*b*, so that even if rain water has passed through narrow gaps that may happen to be formed between these contacted portions, a space "S" is formed immediately behind these gaps. As a result, an effect of so-called reduced-pressure is generated by this space "S", so that the flow of rain water toward the inside of the building board is interrupted, thus causing most of the rain water to flow downward through this space "S" functioning as a gutter.

By the way, in this external corner formative member 10, the second bottom portion 15*b* is provided, which is set back from the position of the first bottom portion 15*a*, and a back plate portion 16 is extended from this second bottom portion 15*b*. Thus, the groove portion 12 is constructed such that when the building board 30 is fitted in this groove portion 12, a broad space "Sa" which is larger than the aforementioned space "S" and defined by the rib 17*b*, the second bottom plate portion 15*b* and the back plate portion 16 is secured on the side of the end face of the building board 30. As a result, the aforementioned effect of reduced-pressure becomes more prominent at this broad space "Sa", so that almost all of the rain water is caused to flow downward through this space "Sa" functioning as a gutter, and therefore, the effect to prevent the leakage of the flow of rain water toward the inside of the building board become almost perfect.

Further, the back plate portion 16 of the groove portion 12 is provided with a ridge 18 which is adapted to be contacted with the back surface of the building board 30 to be fitted in the groove portion 12, thereby functioning as a fourth weir for receiving the kinetic energy of rain water. The side edge portion of the back plate portion 16 of the groove portion 12 is bent inwardly so as to form a lip 16*a* which functions as a fifth weir for receiving the kinetic energy of rain water. Due to the presence of the space "Sa", rain water can be almost completely prevented from reaching the back plate portion 16 of the groove portion 12. However, even if rain water happens to be allowed to reach the back plate portion 16, the rain water is then prevented due to the existence of the ridge 18 from entering further into the inside of the ridge 18, thus causing the rain water to flow downward along this ridge 18. Further, even if rain water is succeeded to pass over the ridge 18 and to move further behind the back plate portion 16, the rain water would be caught by the lip 16*a*.

As explained above, when the external corner formative member 10 of the present invention is employed, the rain water that has been penetrated into the groove portions 12 can be completely caught and forced to flow downward. As a result, it is possible, according to the external corner formative member 10 of the present invention, to prevent rain water from penetrating into a building frame disposed behind the building boards 30, thus achieving a high leakage prevention effect at the external corner portion of a building in addition to an enhancement in design of the external corner of a building and to an improvement in labor saving in the execution of the work.

Figure 3:
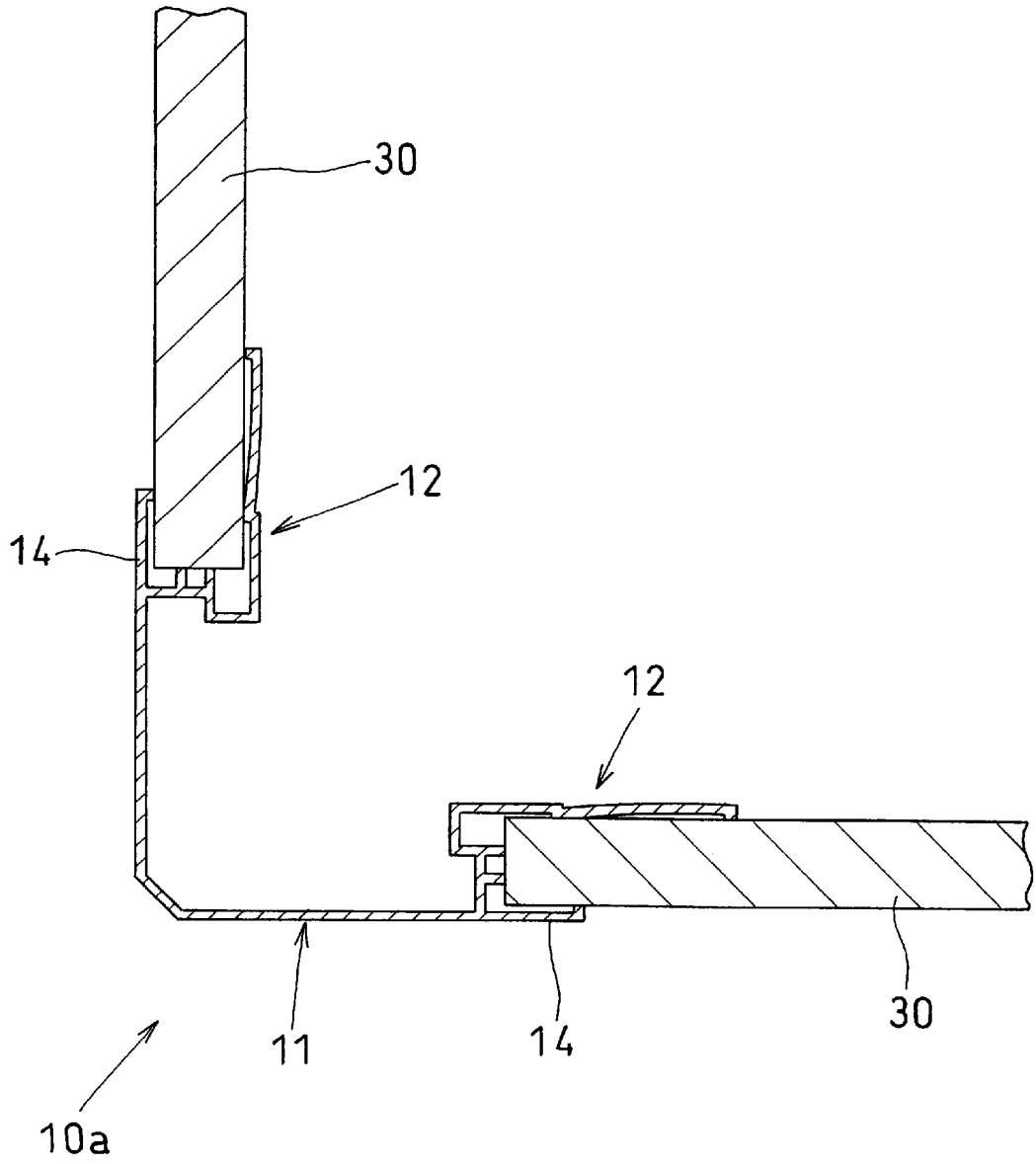
FIG. 3 is a cross-sectional view of the external corner portion of a building frame wherein building boards are attached by making use of an external corner formative member according to another embodiment.

FIG. 3 is a cross-sectional view of the external corner portion of a building frame wherein building boards 30 are attached by making use of an external corner formative member 10*a* according to another embodiment of the present invention. This external corner formative member 10*a* is featured in that the angled corner plate portion 11 is formed flush with the front plate portion 14 of the groove portions 12, and hence, differs in this respect from the external corner formative member 10 shown in FIGS. 1 and 2. Other constructions of the groove portions 12 are the same as those shown in FIGS. 1 and 2. This external corner formative member 10*a* is easy in the molding thereof, and is suited for use where a monotonous design of the external corner portion is desired.

Figure 4:
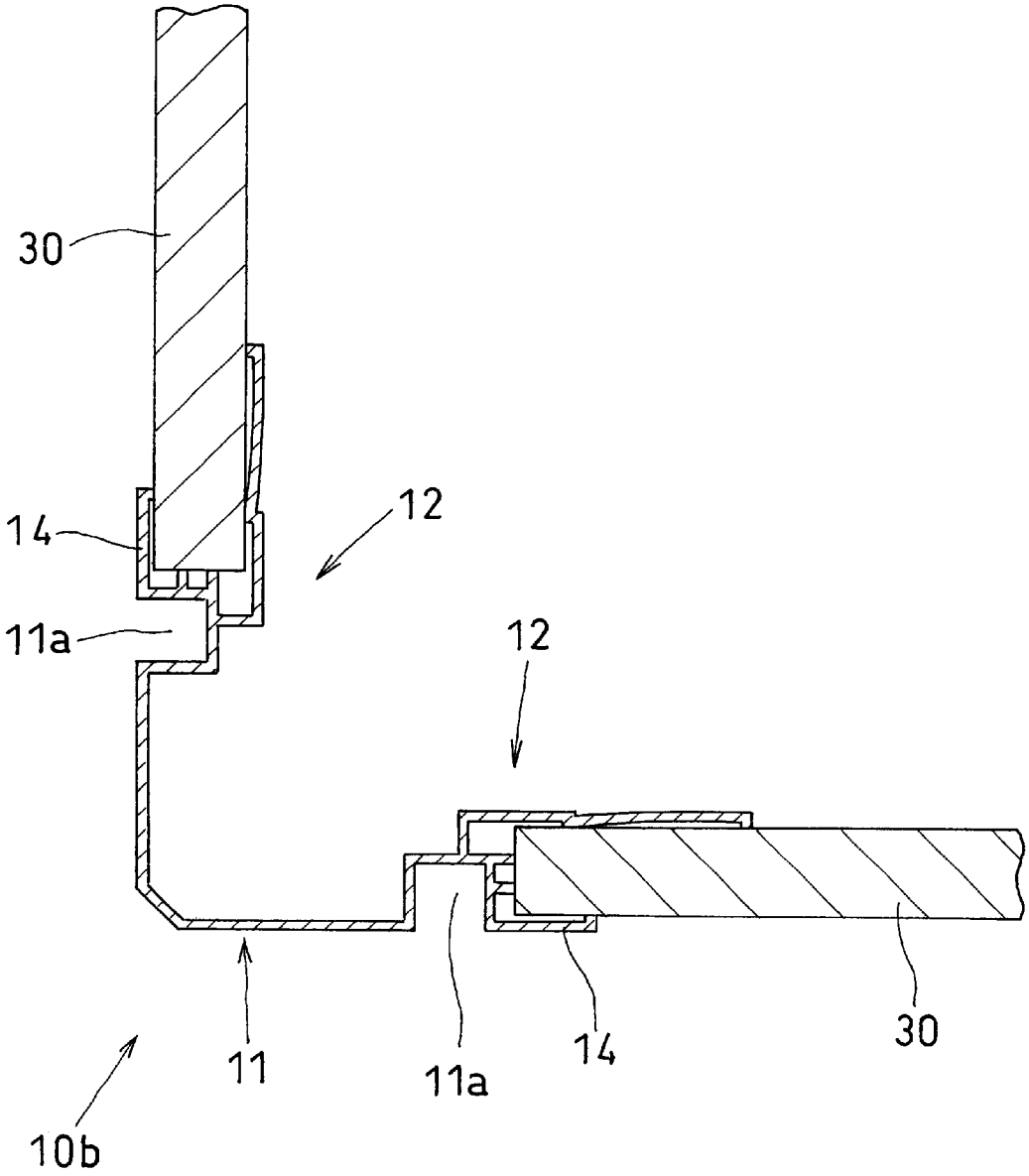
FIG. 4 is a cross-sectional view of the external corner portion of a building frame wherein building boards are attached by making use of an external corner formative member according to still another embodiment.

FIG. 4 is a cross-sectional view of the external corner portion of a building frame wherein building boards 30 are attached by making use of an external corner formative member 10*b* according to another embodiment of the present invention. This external corner formative member 10*b* is featured in that the angled corner plate portion 11 is formed flush with the front plate portion 14 of the groove portions 12, and at the same time, an U-shaped groove 11*a* is formed at the junction between each side edge of the angled corner plate portion 11 and each groove portion 12. Other constructions of the groove portions 12 are the same as those shown in FIGS. 1 and 2. This external corner formative member 10*b* is suited for use where a non-monotonous design of the external corner portion is desired.

As explained above, according to the external corner formative member of the present invention, the rain water is happen to be penetrated into the groove portions can be completely caught and forced to flow downward. As a result, it is possible, according to the external corner formative member of the present invention, to prevent rain water from penetrating into a building frame disposed behind the building boards, thus achieving a high leakage prevention effect at the external corner portion of a building in addition to an enhancement in design of the external corner of a building as well as an improvement in labor saving in the execution of the work.

What is claimed is:

1. An external corner formative member, comprising an angled corner plate portion having opposite side edges, and a pair of groove portions extending from and formed integrally with the side edges, said groove portions being connected only through said corner plate portion, each groove portion including:

a front plate, a back plate, and a bottom plate extending therebetween to define a space for receiving a side edge portion of a building board to be fitted in said groove portion; and at least one rib projecting from the bottom plate into said space for contacting a surface of said side edge portion of said building board and hence functioning as a weir to prevent rain water from passing around said building board;

wherein a first space defined by the front plate, the bottom plate, the at least one rib and said side edge portion of said building board is smaller than a second space defined by the back plate, the bottom plate, the at least one rib and said side edge portion of said building board.

2. The external corner formative member according to claim 1, wherein said back plate of each of said groove portions is provided with a ridge adapted to be contacted with a back surface of a building board to be fitted in said groove portion, thereby functioning as a weir for preventing rain water from passing around said building board.

3. The external corner formative member according to claim 1, wherein a distal edge of the front plate of each of said groove portions is bent inwardly to form a lip with a tip end adapted to be contacted with a front surface of a building board to be fitted in said groove portion, said lip functioning as a weir for receiving the kinetic energy of rain water.

4. The external corner formative member according to claim 1, wherein a distal edge of the back plate of each of said groove portions is bent inwardly to form a lip which functions as a weir for receiving the kinetic energy of rain water.

5. The external corner formative member according to claim 1, wherein said back plate of each of said groove portions is provided with a nailing hole.

6. The external corner formative member according to claim 1, wherein surfaces of the angled corner plate portion and the front plate of each of said groove portions are on different levels.

7. The external corner formative member according to claim 1, wherein the angled corner plate portion is formed flush with the front plate of each of said groove portions.

8. The external corner formative member according to claim 1, further comprising a U-shaped junction between each of said side edges of the angled corner plate portion and each of said groove portions.

9. In combination:

a) an external corner formative member comprising an angled corner plate portion having opposite side edges, and a pair of groove portions extending from and formed integrally with the side edges, each groove portion including a front plate, a back plate and a bottom plate extending therebetween to define a space, and at least one rib projecting from the bottom plate into said space; and b) a building board having a side edge portion received within one of said groove portions;

wherein the at least one rib of said groove portion contacts a surface of said side edge portion of said building board, and hence, functions as a weir to prevent rain water from passing around said building board; and a first space defined by the front plate, the bottom plate and the at least one rib of said groove portion and said side edge portion of said building board is smaller than a second space defined by the back plate, the bottom plate and the at least one rib of said groove portion and said side edge portion of said building board.

10. The combination of claim 9, wherein said groove portions are connected only through said corner plate portion.

11. The combination of claim 9, further comprising another building board having a side edge portion received within the other of said groove portions.

12. The combination of claim 9, wherein the back plate of said groove portion further includes a ridge in contact with a back surface of said building board, said ridge functions as a weir for preventing rain water from passing around said building board.

13. The combination of claim 9, wherein a distal edge of the front plate of said groove portion is bent inwardly to form a lip with a tip end in contact with a front surface of said building board, said lip functions as a weir for receiving the kinetic energy of rain water.

14. The combination of claim 9, wherein a distal edge of the back plate of said groove portion is bent inwardly to form a lip which functions as a weir for receiving the kinetic energy of rain water.

15. The combination of claim 9, further comprising a pole and said groove portion is attached to the pole by at least one nail so that the head of the nail is hidden behind said building board.

16. The combination of claim 9, wherein surfaces of the angled corner plate portion and the front plate of each of said groove portions are on different levels.

17. The combination of claim 9, wherein the corner formative member further comprises a U-shaped junction between each of said side edges and each of said groove portions.

* * * * *